US008366242B2

(12) United States Patent
Koda et al.

(10) Patent No.: US 8,366,242 B2
(45) Date of Patent: Feb. 5, 2013

(54) LIQUID-EJECTION HEAD UNIT AND IMAGE FORMING APPARATUS

(75) Inventors: Tomohiko Koda, Atsugi (JP); Kenichi Yoshimura, Kawasaki (JP); Tomiyoshi Takano, Atsugi (JP); Mitsuru Kawakami, Atsugi (JP); Masami Iwama, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 283 days.

(21) Appl. No.: 12/825,742

(22) Filed: Jun. 29, 2010

(65) Prior Publication Data

US 2010/0328400 A1 Dec. 30, 2010

(30) Foreign Application Priority Data

Jun. 29, 2009 (JP) ..... 2009-154211

(51) Int. Cl.
*B41J 2/16* (2006.01)

(52) U.S. Cl. ..... 347/50; 347/59; 347/58; 347/87

(58) Field of Classification Search ..... 347/50, 347/59, 58, 87, 108
See application file for complete search history.

(56) References Cited

U.S. PATENT DOCUMENTS

| | | | |
|---|---|---|---|
| 6,843,554 | B2 | 1/2005 | Nagata et al. |
| 6,918,180 | B2 | 7/2005 | Koda et al. |
| 7,077,511 | B2 | 7/2006 | Machida et al. |
| 7,163,279 | B2 | 1/2007 | Shimizu et al. |
| 7,294,952 | B2 | 11/2007 | Ito |
| 7,494,210 | B2 | 2/2009 | Yamada et al. |
| 7,681,987 | B2 | 3/2010 | Tobita et al. |
| 7,695,114 | B2 | 4/2010 | Koda et al. |
| 2008/0291232 | A1 | 11/2008 | Yamada et al. |
| 2008/0316274 | A1 | 12/2008 | Kondo |
| 2008/0316280 | A1 | 12/2008 | Yamada et al. |
| 2009/0244202 | A1 | 10/2009 | Kida et al. |
| 2010/0002051 | A1 | 1/2010 | Yoshimura |

FOREIGN PATENT DOCUMENTS

| | | |
|---|---|---|
| JP | 10-58756 | 3/1998 |
| JP | 2003-25562 | 1/2003 |
| JP | 2006-315336 | 11/2006 |
| JP | 3909746 | 2/2007 |
| JP | 2007-53136 | 3/2007 |
| JP | 2007-53137 | 3/2007 |
| JP | 2007-62312 | 3/2007 |
| JP | 2008-230016 | 10/2008 |
| JP | 2009-978 | 1/2009 |
| JP | 4243850 | 1/2009 |

*Primary Examiner* — Matthew Luu
*Assistant Examiner* — Henok Legesse
(74) *Attorney, Agent, or Firm* — Cooper & Dunham LLP

(57) ABSTRACT

A liquid-ejection head unit includes a head, an electric-circuit board, electronic components, and a storage tank. The head includes a frame member and ejects droplets of liquid. The electronic components are mounted on the electric-circuit board and connected to the head. The storage tank stores liquid supplied to the head. The electric-circuit board is disposed between the frame member of the head and the storage tank to form a single multi-layered structure. The electronic components of the electric-circuit board are accommodated in at least one of a first internal space defined by the frame member of the head and the electric-circuit board and a second internal space defined by the electric-circuit board and the storage tank.

12 Claims, 15 Drawing Sheets

LIQUID-EJECTION HEAD UNIT AND IMAGE FORMING APPARATUS

CROSS-REFERENCE TO RELATED APPLICATIONS

The present patent application claims priority pursuant to 35 U.S.C. §119 from Japanese Patent Application No. 2009-159211, filed on Jun. 29, 2009 in the Japan Patent Office, which is incorporated herein by reference in its entirety.

BACKGROUND OF THE DISCLOSURE

1. Field of the Disclosure

Exemplary embodiments of the present disclosure relate to an image forming apparatus, and more specifically to a liquid-ejection head unit and an image forming apparatus including the liquid-ejection head unit.

2. Description of the Background

Image forming apparatuses are used as printers, facsimile machines, copiers, plotters, or multi-functional peripherals having two or more of the foregoing capabilities. As one type of image forming apparatus employing a liquid-ejection recording method, an inkjet recording apparatus is known that uses a recording head formed with a liquid ejection head (liquid-droplet ejection head) for ejecting droplets of ink.

Such image forming apparatuses employing the liquid-ejection recording method eject droplets of ink or other liquid from the recording head onto a recording medium to form a desired image (hereinafter "image formation" is used as a synonym for "image recording" and "image printing"). Such liquid-ejection-type image forming apparatuses fall into two main types: a serial-type image forming apparatus that forms an image by ejecting droplets from the recording head while moving the recording head in a main scan direction, and a line-head-type image forming apparatus that forms an image by ejecting droplets from a linear-shaped recording head held stationary in the image forming apparatus.

In such an image forming apparatus employing a liquid ejection head, mist arises in ejecting liquid droplets. Such mist may adhere to an electric-circuit board on which electronic components for driving the head are mounted, causing malfunction or failure of the electric components.

Hence, for example, in a conventional technique described in JP-2003-025562-A, an ink ejection head is proposed that includes a head to eject ink droplets, a head case that holds the head and supplies ink to the head, a cartridge case that supplies ink to the head case, and a circuit board that transmits electric signals to the head. The circuit board is sandwiched between the head case and the cartridge case, and ribs are provided to restrict the movement of the electric board.

In another conventional technique described in JP-2009-000978-A, the head unit is covered with a head spacer member, and an opening of the head spacer member hermetically sealed, with the electric-circuit board connected to the head unit. One side of the electric-circuit board is insulated.

In still another conventional technique described in JP-H10-058756-A, a compact printing device includes a printing unit, an ink storage unit to supply ink to the printing unit, and an electric board to apply electric signals to the printing unit. At least one portion of the surface of the electric circuit is covered with insulation, and the portion covered is disposed inside the ink storage unit.

There is a demand for downsizing such liquid-ejection head units, and components of the head units are increasingly downsized and packaged with higher density. Further, the electric-circuit board that transmits signals to drive the head is increasingly packaged with higher density, and wiring patterns and electronic components are densely deployed. The electronic components and other components may be mounted on both sides of the electric-circuit board, and in consideration of such arrangement, surrounding members need to be separated therefrom. However, as described above, ink mist caused by ink ejection may adhere to and damage the electronic components.

In such a case, for the technique described in JP-2003-025562-A, the electric circuit is not fixed on the cartridge case, gaps remain between the components, thus making it difficult to prevent mist from damaging the electric circuit. For the technique described in JP-2009-000978-A, one side of the electric-circuit board is subjected to insulation processing, causing an increased cost. Further, when the components are disposed on both sides of the board, insulation processing is difficult to perform and upsizing of the head spacer member is needed to contain the head, causing upsizing of an apparatus employing the head unit.

For the technique described in JP-H10-058756-A, a portion of an ink channel is sealed with the insulated electric-circuit board. With such a configuration, jointing of the components is difficult to perform, and since all components implemented on one side of the board need be subjected to insulation processing, it may be difficult to test or evaluate the insulation processing.

SUMMARY

In at least one exemplary embodiment, there is provided an improved liquid-ejection head unit includes a head, an electric-circuit board, electronic components, and a storage tank. The head includes a frame member and ejects droplets of liquid. The electronic components are mounted on the electric-circuit board and connected to the head. The storage tank stores liquid supplied to the head. The electric-circuit board is disposed between the frame member of the head and the storage tank to form a single multi-layered structure. The electronic components of the electric-circuit board are accommodated in at least one of a first internal space defined by the frame member of the head and the electric-circuit board and a second internal space defined by the electric-circuit board and the storage tank.

In at least one exemplary embodiment, there is provided an improved liquid-ejection head unit including a head, an electric-circuit board, electronic components, a storage tank, and a filter unit. The head includes a frame member and ejects droplets of liquid. The electronic components are mounted on the electric-circuit board and connected to the head. The storage tank stores liquid supplied to the head. The filter unit is disposed between the storage tank and the electric-circuit board that filters liquid supplied from the storage tank. The filter unit, the frame member, the electric-circuit board, and the storage tank form a single multi-layered structure. The electronic components of the electric-circuit board are accommodated within at least one of a first internal space defined by the frame member of the head and the electric-circuit board and a second internal space defined by the electric-circuit board and the filter unit.

BRIEF DESCRIPTION OF THE DRAWINGS

Additional aspects, features, and advantages will be readily ascertained as the same becomes better understood by reference to the following detailed description when considered in connection with the accompanying drawings, wherein.

Figure 1:
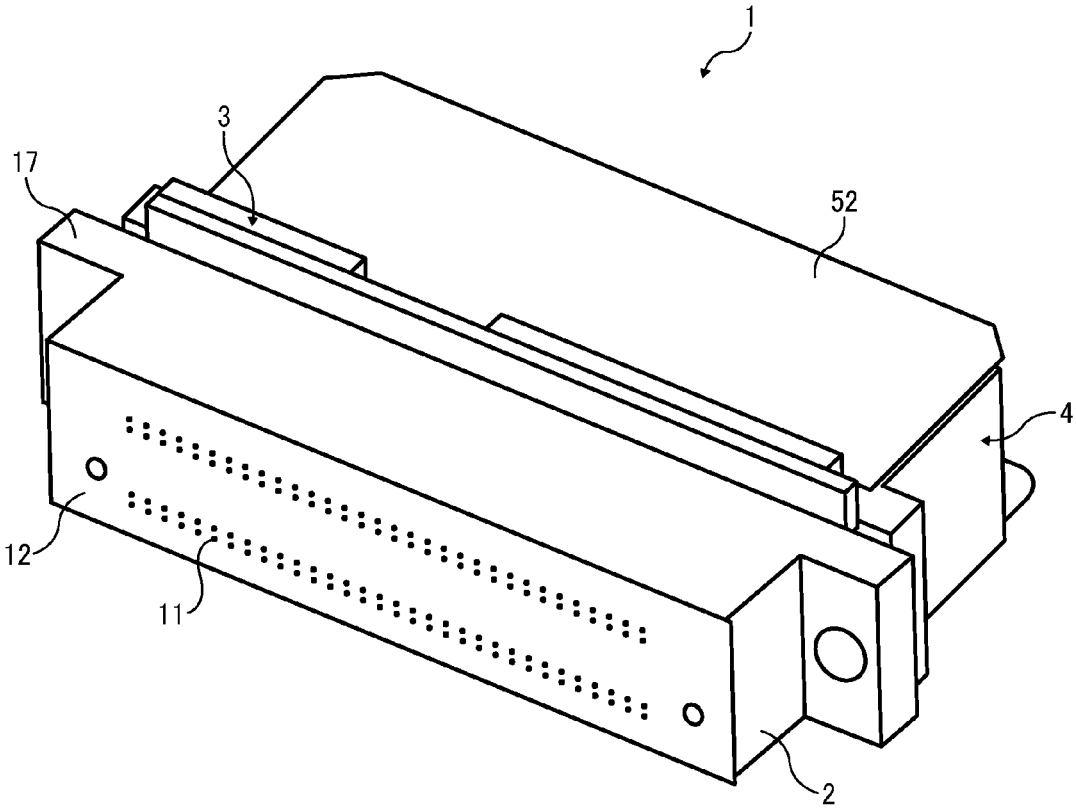
FIG. 1 is an outer perspective view illustrating a liquid-ejection head unit according to a first exemplary embodiment of this disclosure.

The accompanying drawings are intended to depict exemplary embodiments of the present disclosure and should not be interpreted to limit the scope thereof. The accompanying drawings are not to he considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "image" used herein is not limited to a two-dimensional image and includes, for example, an image applied to a three dimensional object and a three dimensional object itself formed as a three-dimensionally molded image. The term "sheet" used herein is not limited to a sheet of paper and includes anything such as an CHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description s not intended to limit the scope of the invention and all of the components or elements described in the exemplary embodiments of this disclosure are not necessarily indispensable to the present invention.

Below, exemplary embodiments according to the present disclosure are described with reference to the attached drawings.

A liquid-ejection head unit 1 according to a first exemplary embodiment of the present disclosure is described with reference to FIGS. 1 to 5.

Figure 2:
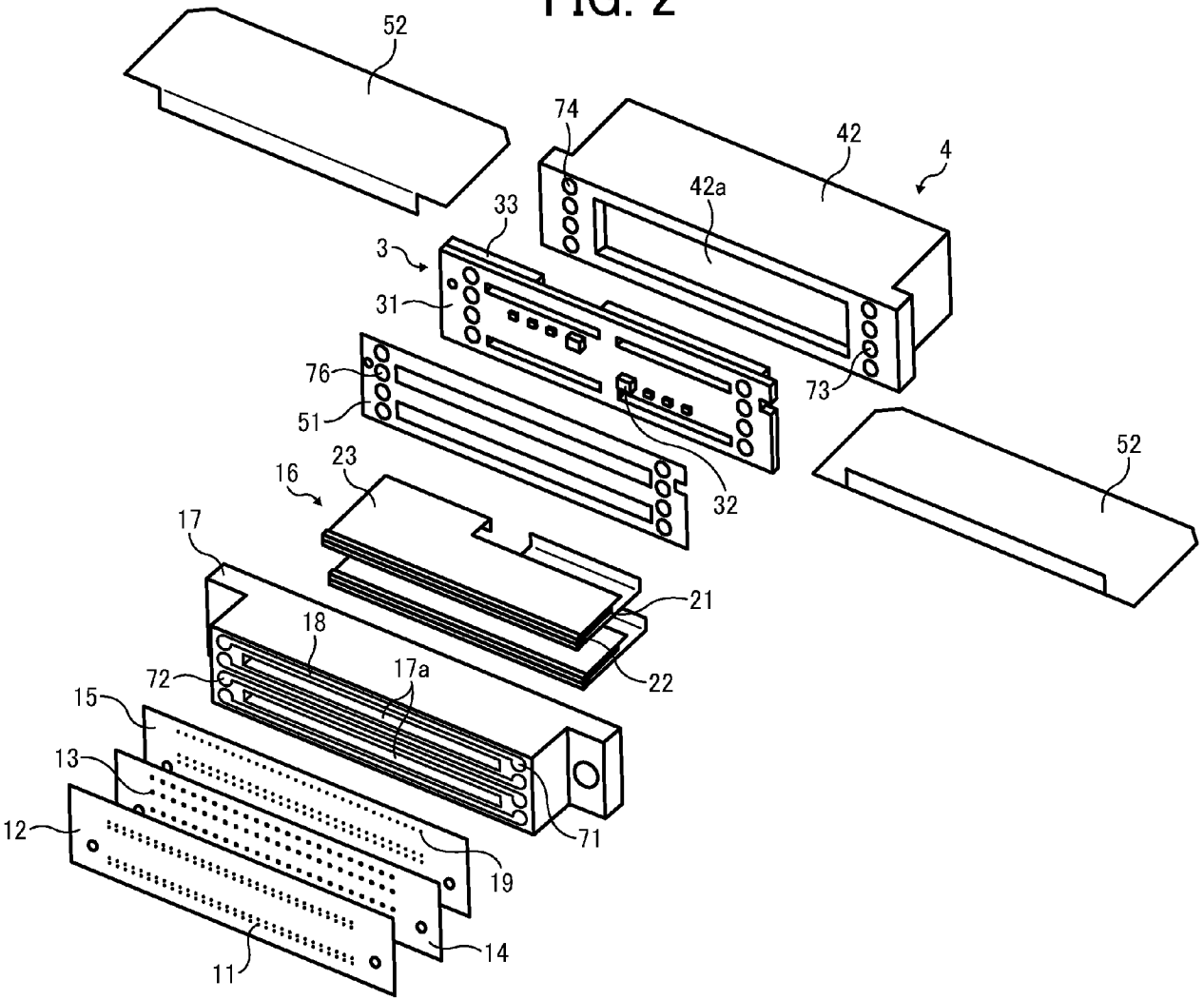
FIG. 2 is an exploded perspective view illustrating the liquid-ejection head unit illustrated in FIG. 1.
Figure 3:
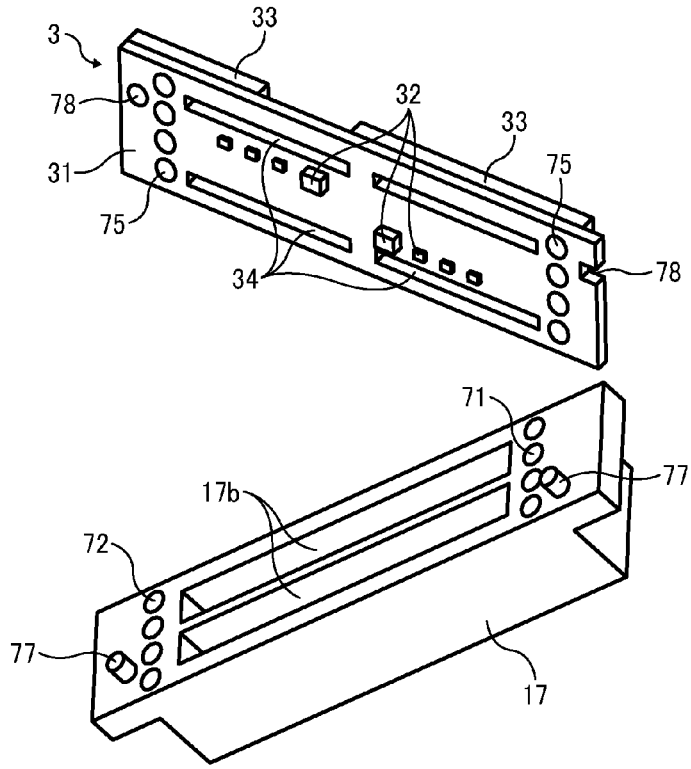
FIG. 3 is a perspective view illustrating a frame member and an electric-circuit board of the liquid-ejection head unit.
Figure 4:
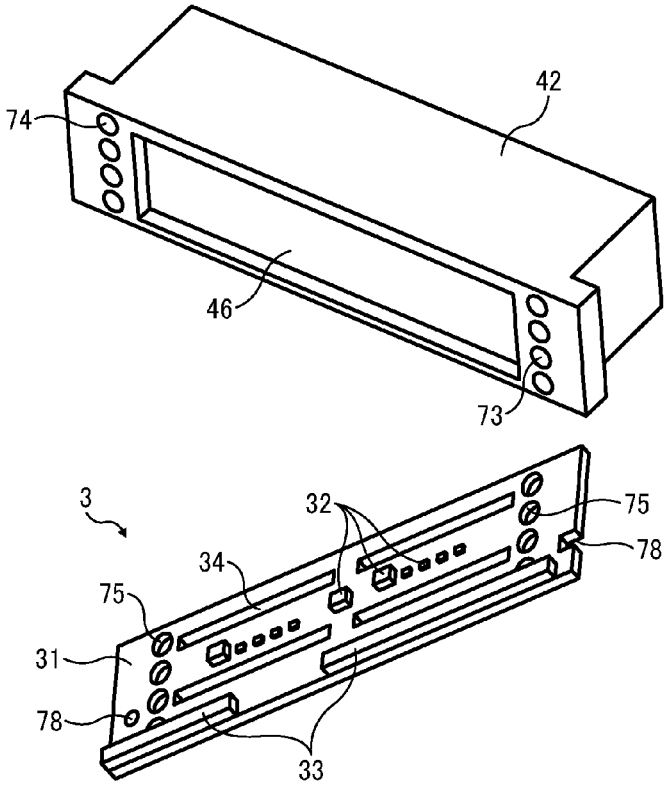
FIG. 4 is a perspective view illustrating a tank and the electric-circuit board of the liquid-ejection head unit.
Figure 5:
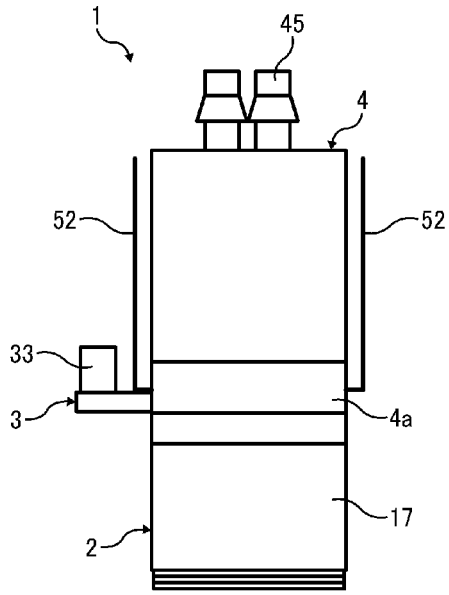
FIG. 5 is a side view illustrating the liquid-ejection head unit.
Figure 6:
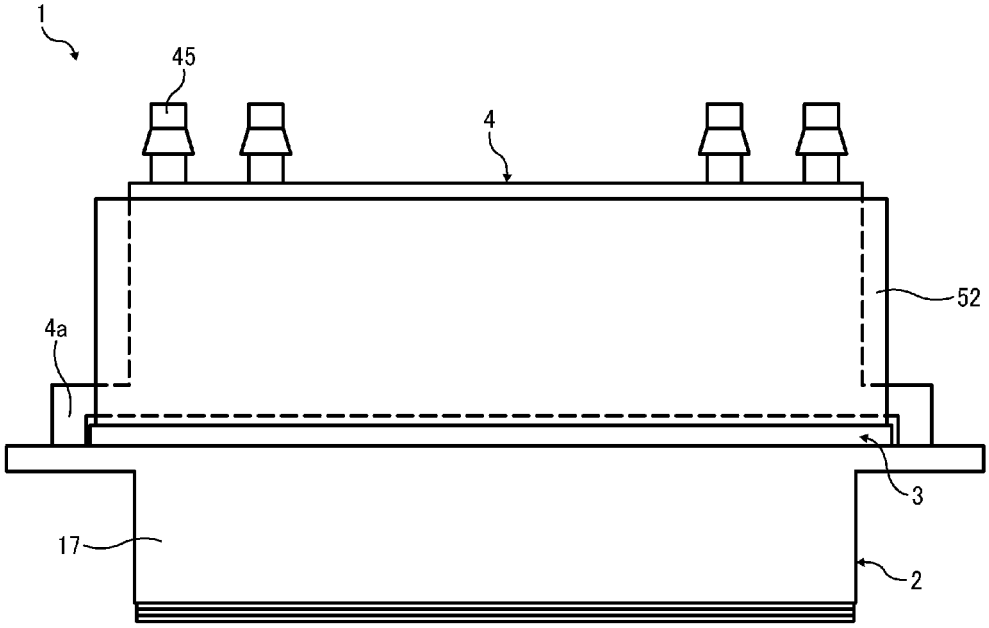
FIG. 6 is a front view illustrating the liquid-ejection head unit.
Figure 7:
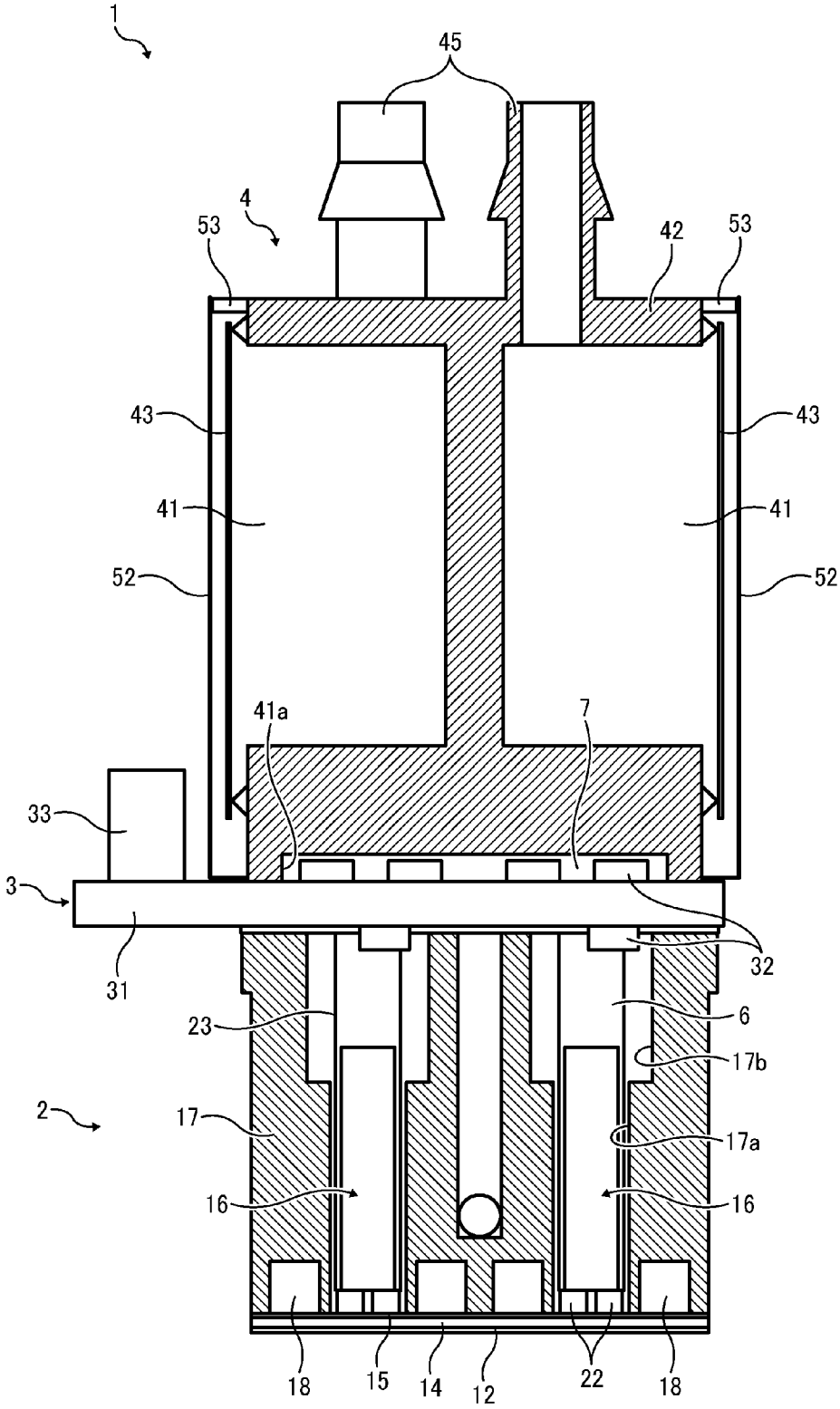
FIG. 7 is a cross-sectional side view illustrating the liquid-ejection head unit.
Figure 8:
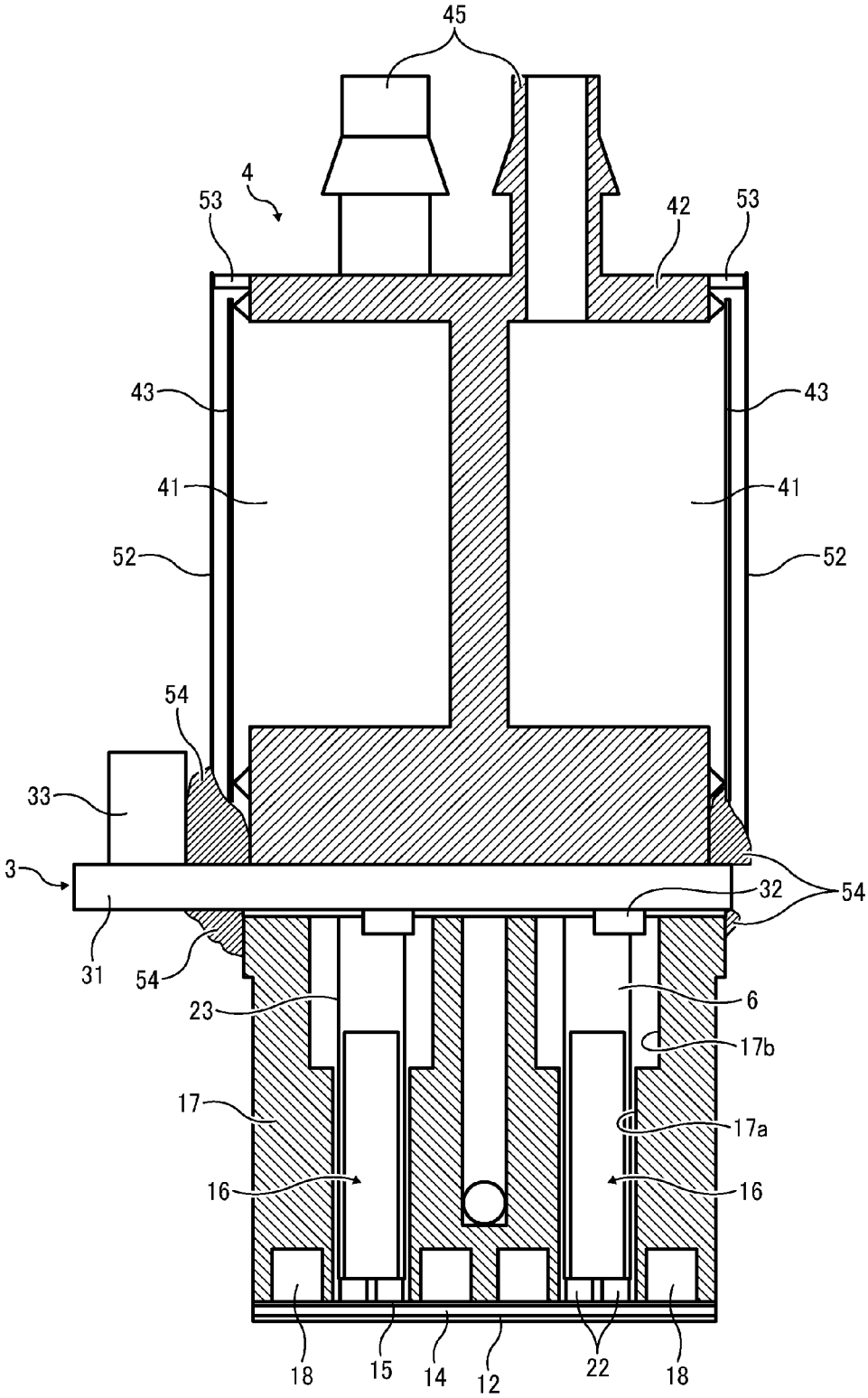
FIG. 8 is a cross-sectional side view illustrating a seal member of the liquid-ejection head unit.
Figure 9:
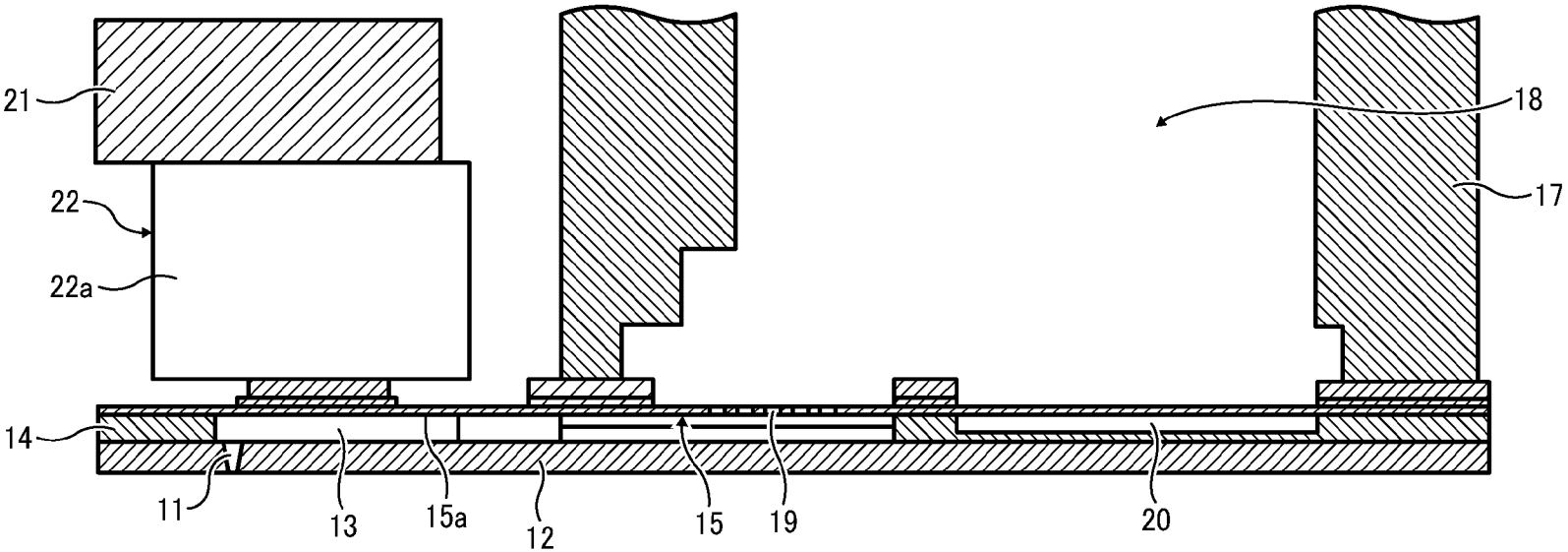
FIG. 9 is a cross-sectional view illustrating a portion of the liquid-ejection head unit.

FIG. 1 is an outer perspective view illustrating the liquid-ejection head unit 1. FIG. 2 is an exploded perspective view illustrating the liquid-ejection head unit 1. FIG. 3 is a perspective view illustrating a frame member 17 and an electric-circuit board 3 of the liquid-ejection head unit 1. FIG. 4 is a perspective view illustrating a tank 4 and the electric-circuit board 3 of the liquid-ejection head unit 1. FIG. 5 is a side view illustrating the liquid-ejection head unit 1. FIG. 6 is a front view illustrating the liquid-ejection head unit 1. FIG. 7 is a cross-sectional side view illustrating the liquid-ejection head unit 1. FIG. 8 is a cross-sectional side view illustrating a seal member of the liquid-ejection head unit. FIG. 9 is a cross-sectional view illustrating a portion of the liquid-ejection head unit 1.

The liquid-ejection head unit 1 (hereinafter, simply referred to as "head unit 1") includes the head 2 that ejects liquid droplets, the electric-circuit board 3 on which electronic components connected to the head 2 are implemented, and the tank 4 that stores ink supplied to the head 2. The member 17 of the head 2, the electric-circuit board 3, and the tank 4 are layered to form a single integrated unit. The frame member 17 and the electric-circuit board 3 together define spaces 6. The electric-circuit board 3 and the tank 4 together define a space 7. The electronic components 32 of the electric-circuit board 3 are accommodated in the spaces 6 and 7.

The head 2 includes a nozzle plate 12 in which nozzles 11 are formed to eject liquid droplets, a channel plate 14 in which separate chambers 13 communicated with the nozzles 11 are formed, a diaphragm member 15 in which diaphragms 15*a* constituting part of wall faces of the corresponding separate chambers 13 are formed, two piezoelectric actuators 16 that deform the diaphragms 15*a*, and the frame member 17 that holds the nozzle plate 12, the channel plate 14, and the diaphragm member 15 at a front side thereof. The frame member 17 also includes the piezoelectric actuators 16 and common chambers 18 from which ink is supplied to the separate chambers 13.

Each of the piezoelectric actuators 16 includes multi-layer piezoelectric-element members 22 that are two pressure generation members bonded to a base 21. The piezoelectric-element members 22 are subjected to slit processing to form piezoelectric-element pillars 22*a* corresponding to the separate chambers 13. To each of the piezoelectric-element members 22 is joined a flexible wiring board 23, such as a flexible printed circuit (FPC), electrically connecting the corresponding piezoelectric-element pillar 22*a* to the electric-circuit board 3.

In addition to the common chambers 18 described above, the frame member 17 includes first openings 17*a* that accommodate the piezoelectric actuators 16 and second openings 17*b* that form the spaces 6. The frame member 17 may made of metal, e.g., SUS, or resin.

The diaphragm member 15 includes a filter portion 19 that includes liquid supply ports between the common chambers 18 and the separate chambers 13. As illustrated in FIG. 9, a damper chamber 20 is disposed so as to sandwich the diaphragm member 15 between the damper chamber 20 and the common chamber 18.

In the electric-circuit board 3, the electronic components 32 are implemented on both faces of a main board 31 and connected to the piezoelectric actuators 16 via wiring patterns on both the flexible wiring boards 23 and the electric-circuit board 3. On the main board 31 is further mounted flexible foil connectors (FFCs) 33 to connect the head unit 1 to a control board, such as a controller of the image forming apparatus. Openings 34 through which the flexible wiring boards 23 pass are formed in the main board 31. Such double-face implementation is advantageous in increasing the density of components for downsizing. Alternatively, the electronic components 32 may be disposed on either the frame-member side or the tank side.

The tank 4 includes a tank case 42, elastically deformable members 43, and connecting portions (ports) 45. The tank case 42 is made of, e.g., polystyrene or polypropylene, and includes two ink chambers 41. The elastically deformable members 43 (hereinafter referred to as "flexible film member") are provided at openings of the tank case 42. The connecting portions 45 are connected to supply paths through which ink is supplied from the outside of the head unit 1 to the ink chambers 41.

As described above, the head unit 1 includes the head 2 that ejects liquid droplets, the electric-circuit board 3 on which the electronic components connected to the head 2 are implemented, and the tank 4 that stores ink to be supplied to the head 2. The frame member 17 of the head 2, the electric-circuit board 3, and the tank 4 are layered to form a single integrated unit. The spaces 6 and the space 7 are formed between the frame member 17 and the electric-circuit board 3 and between the electric-circuit board 3 and the tank 4, respectively, to accommodate the electronic components 32 of the electric-circuit board 3. Such a configuration protects the electronic components 32 of the electric-circuit board 3 from ink mist, enhancing reliability. Further, accommodating the electronic components 32 in the frame member 17 and the tank 4 allows downsizing of the head unit 1.

In the above-described exemplary embodiment, an insulation sheet 51 is disposed between the frame member 17 and the electric-circuit board 3. Accordingly, even when the frame member 17 is made of metal (e.g., SUS) or other electrically-conductive material, the insulation sheet 51 allows a wiring pattern to be formed on a surface of the main board 31 of the electric-circuit board 3. Such configuration can increase the component density of the electric-circuit board 3, allowing downsizing of the head unit 1. In this regard, the insulation sheet 51 is disposed around fixing areas of the electric-circuit board 3.

Shield members 52 are disposed between the electric-circuit board 3 and the tank 4 to shield, from the outside, a gap remaining between the electric-circuit board 3 and the tank 4. The shield members 52 may be, e.g., resin-film members of substantially L-shape. Such a configuration effectively prevents mist from entering from the gap between the electric-circuit board 3 and the tank 4 to the space 7. Alternatively, as illustrated in FIG. 8, seal members 54 may be employed to seal the gap between the electric-circuit board 3 and the tank 4 instead of or along with the shield members 52.

The shield members 52 are disposed so as to cover the outer faces of the flexible film members 43 of the tank 4, thus preventing mist from adhering to the outer faces of the flexible film members 43.

In this configuration, the tank case 42 of the tank 4 is provided with protrusions (gap spacer members) 53 that hold the shield members 52 away from the flexible film members 43. Such a configuration prevents movement of the flexible film members 43 from being blocked by contact of the flexible film members 43 with the shield members 52, and also prevents the flexible film members 43 from being damaged by contact of the connectors 33 with the flexible film members 43 when the connectors 33 are connected to or disconnected from corresponding connecters of the image forming apparatus.

The common chambers 18 of the frame member 17 have supply ports 71 and output ports 72. Likewise, the tank 4 has supply ports 73 and an output ports 74. The supply port 71 and the output port 72 of the frame member 17 are connected to the supply ports 73 and the output ports 74 of the tank 4 via through holes 75 of the electric-circuit board 3 and through holes 76 of the insulation sheet 51, respectively. The connecting portions are sealed with, e.g., rubber gaskets. With such a configuration, ink is supplied from the tank 4 to the common chambers 18 of the head 2 via the through holes 75 of the electric-circuit board 3. Thus, supplying and outputting ink between the tank 4 and the head 2 through the electric-circuit board 3 allows a surface of the electric-circuit board 3 opposite a surface facing the frame member 17 to be covered with the tank 4.

For the connection via the through holes 75 of the electric-circuit board 3, ink may not directly pass the through holes 75. For example, the supply port 71 and the output port 72 of the frame member 17 may protrude through the through holes 75 to be connected to the supply port 73 and the output port 74. Such a configuration obviates sealing a gap between the electric-circuit board 3 and each of the frame member 17 and the tank 4, and accordingly it is sufficient to seal only a gap remaining between the frame member 17 and the tank 4. Alternatively, the supply port 73 and the output port 74 of the tank 4 may be formed to protrude through the through holes 75.

The electric-circuit board 3 and the frame member 17 are positioned with positioning pins 77 and positioning holes (or notches) 78 and bonded with, e.g., ultraviolet curing adhesive.

As illustrated in FIG. 6, contact portions 4a of the tank case 42 of the tank 4 are in contact with the frame member 17 of the head 2. Such direct contact of the tank 4 with the frame member 17 of the head 2 allows the electric-circuit board 3 to be sandwiched between the tank 4 and the frame member 17 without giving load on the electric-circuit board 3. Such a configuration prevents damage to the electric-circuit board 3 on mounting and breakage of the insulation sheet 51 due to overload.

Next, a liquid-ejection head unit 1 according to a second exemplary embodiment is described with reference to FIG. 10.

Figure 10:
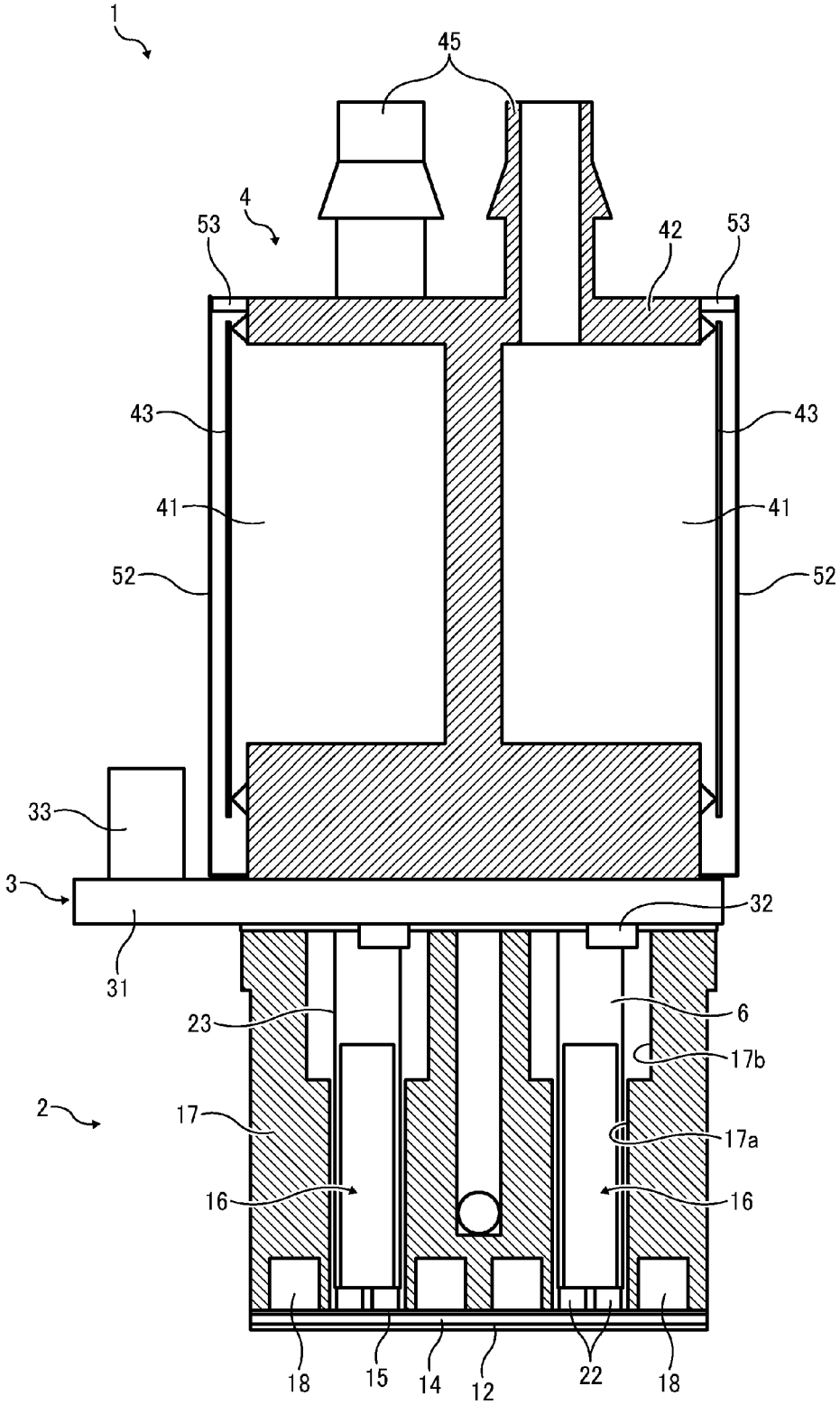
FIG. 10 is a cross-sectional side view illustrating a liquid-ejection head unit according to a second exemplary embodiment of this disclosure.

In FIG. 10, electronic components 32 are implemented on a single (head-side) face of an electric-circuit board 3 facing the head 2 and accommodated in spaces 6 of a frame member 17 of a head 2. On the other hand, a space 7 like that described in the first exemplary embodiment is not provided in a tank 4. Alternatively, the electronic components 32 may be implemented on a single (tank-side) face of the electric-circuit board 3 facing the tank 4 and accommodated in a space 7 of the tank 4. In such a case, the spaces 6 like that described in the first exemplary embodiment may not be provided in the frame member 17 of the head 2. Meanwhile, openings 17*a* for piezoelectric actuators 16 are provided as with the first exemplary embodiment.

Figure 11:
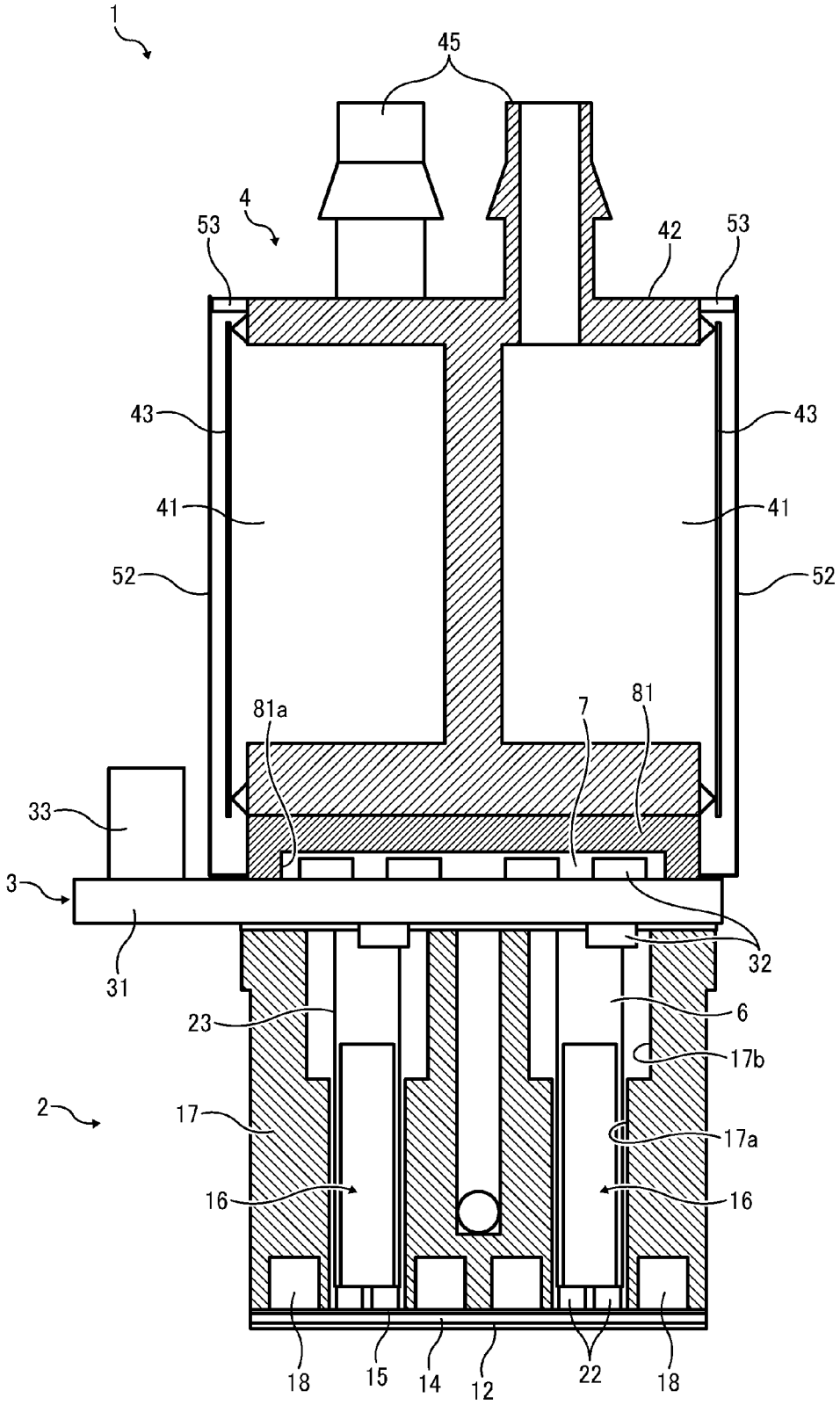
FIG. 11 is a cross-sectional side view illustrating a liquid-ejection head unit according to a third exemplary embodiment of this disclosure.

Next, a liquid-ejection head unit 1 according to a third exemplary embodiment is described with reference to FIG. 11.

In this exemplary embodiment, a filter unit 81 is disposed between a tank 4 and an electric-circuit board 3. The filter unit 81 includes a recessed portion 81*a* that forms a space 7 to accommodate electronic components 32 of the electric-circuit board 3.

Figure 12:
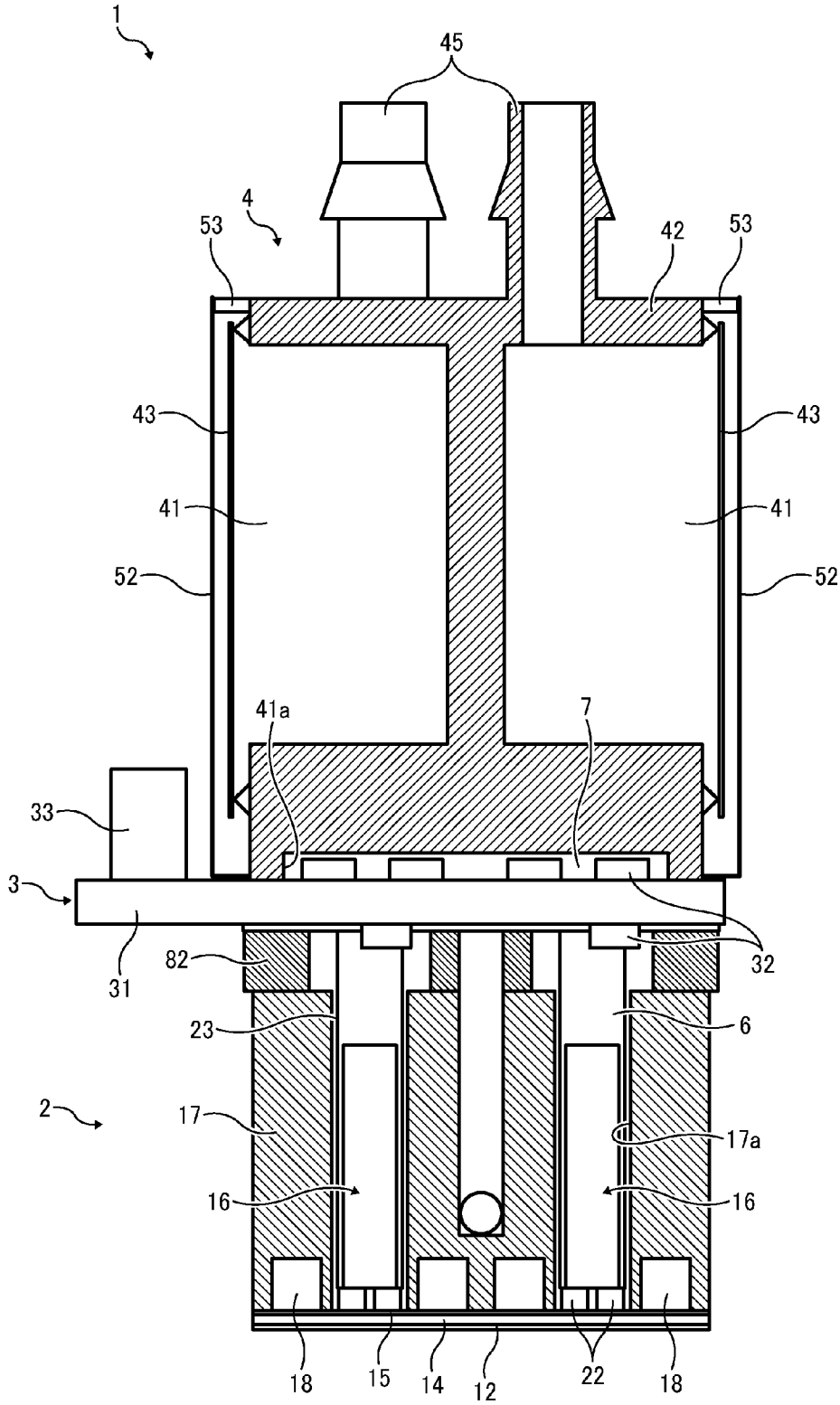
FIG. 12 is a cross-sectional side view illustrating a liquid-ejection head unit according to a fourth exemplary embodiment of this disclosure.

Next, a liquid-ejection head unit 1 according to a fourth exemplary embodiment is described with reference to FIG. 12.

In this exemplary embodiment, an intermediate member 82 is disposed between a frame member 17 of a head 2 and an electric-circuit board 3 to form spaces 6. Likewise, another intermediate member may be disposed between a tank 4 and the electric-circuit board 3 to form a space 7. In this disclosure, the spaces between the electric-circuit board 3 and the frame member 17 and the space between the electric-circuit board 3 and the tank 4 may be formed by disposing such an intermediate member (spacer member).

As described above, such spaces are disposed in the frame member 17 and/or the tank 4. However, the size of the spaces may be limited in order to secure the spaces for the piezoelectric actuators 16 and the strength of the tank case 42 of the tank 4. In such a case, the intermediate member 82 can effectively increase the size of the spaces for accommodating the electronic components 32 without substantially increasing the size of the head unit 1.

Figure 13:
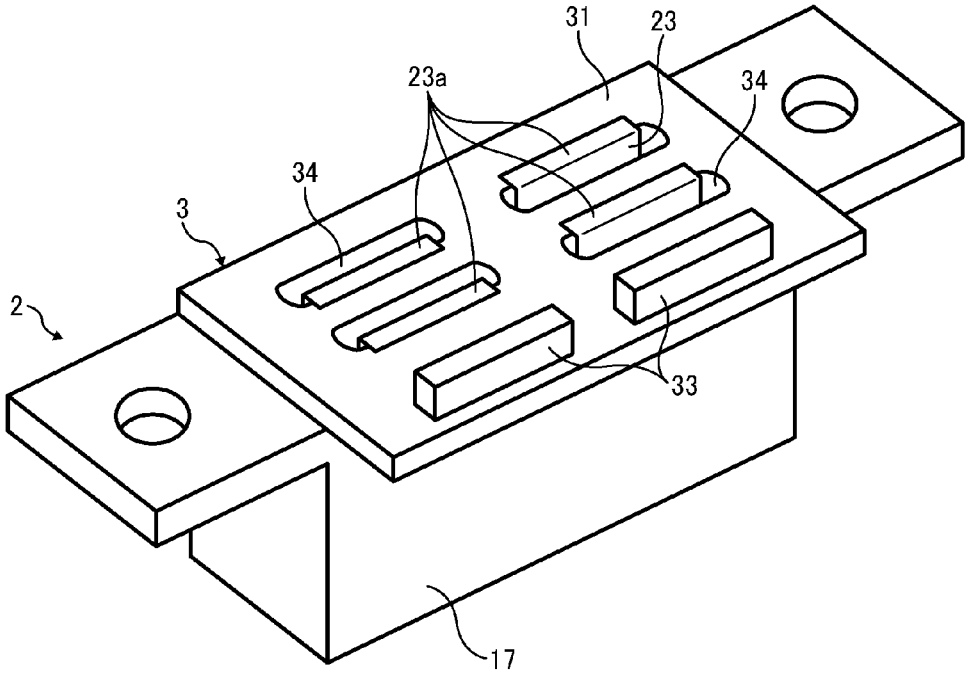
FIG. 13 is a perspective view illustrating a configuration of connection between flexible wiring boards and an electrical-circuit board.
Figure 14:
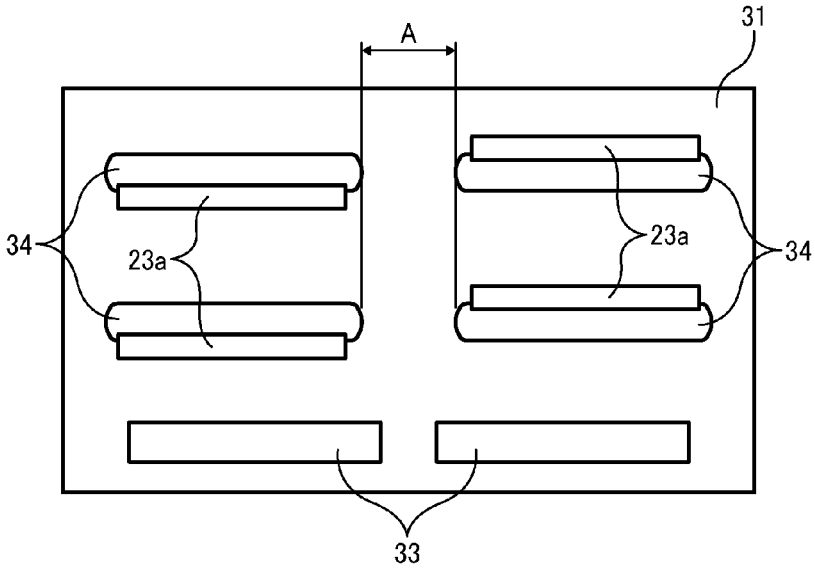
FIG. 14 is a plan view illustrating the configuration of connection illustrated in FIG. 13.

Next, a configuration of connection between the flexible wiring boards 23 of the head 2 and the electric-circuit board 3 in the above-described exemplary embodiments is illustrated in FIGS. 13 and 14.

As described above, the head 2 includes the piezoelectric-element members 22 in which two lines of the piezoelectric-element pillars 22*a* are provided for each of the two piezoelectric actuators 16, and the two flexible wiring boards 23 are provided for each of the piezoelectric-element members 22. For the electric-circuit board 3, the plurality of connectors 33 and the electronic components 32 are disposed on the main board 31, and wiring patterns, not illustrated, are formed on the main board 31.

The flexible wiring boards 23 are led through the openings 34 to a side connected to the wiring pattern of the electric-circuit board 3. End portions of the flexible wiring boards 23 near input terminals 23*a* are bent at positions at which the end portions do not face each other and connected to the wiring pattern of the electric-circuit board 3. The connectors 33 of the electric-circuit board 3 are disposed side by side in a long direction of the electric-circuit board 3.

As described above, the input terminals 23*a* of the flexible wiring boards 23 are disposed to either side of the electric-circuit board 3 at positions at which the input terminals 23*a* do not face each other. Such a configuration can secure an area A, like that illustrated in FIG. 14, across a middle portion of the electric-circuit board 3 in a short direction of the head 2. Thus, the wiring pattern connected to the input terminals 23*a* is easily led in the short direction of the head 2, thus allowing the connectors 33 to be disposed side by side in the long direction of the head 2.

Figure 15:
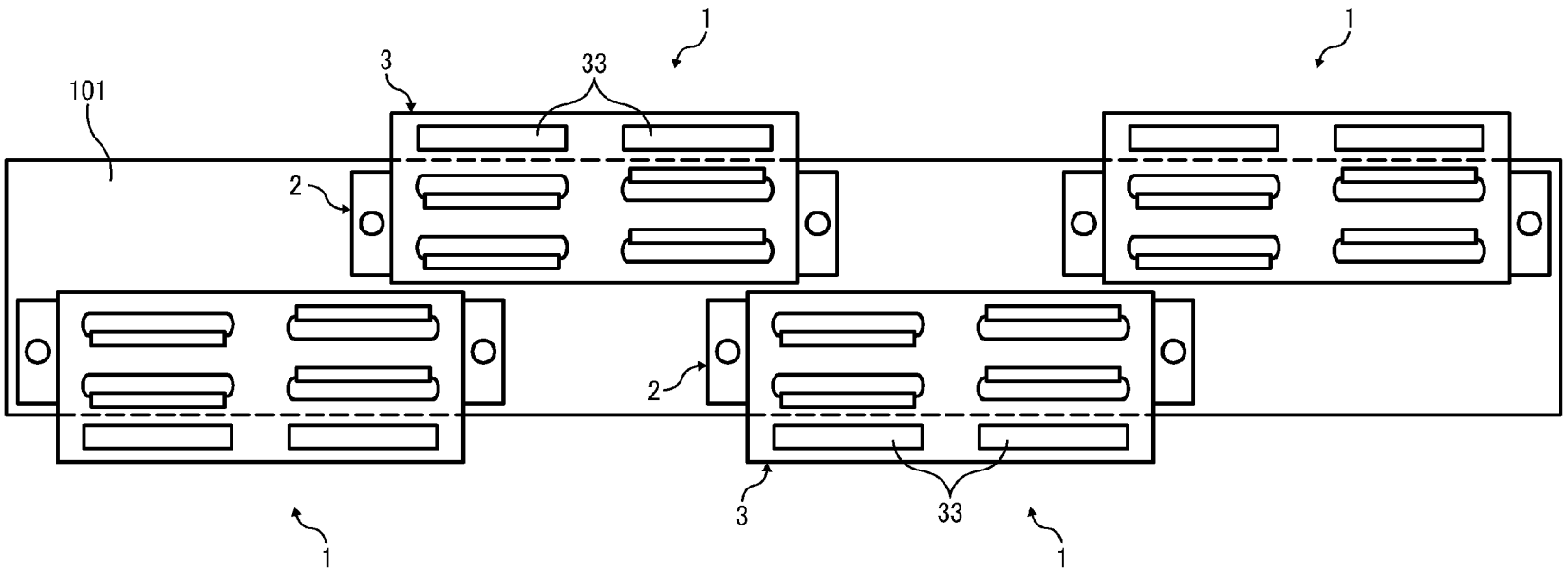
FIG. 15 is a plan view illustrating a configuration of a line-head array in which a plurality of liquid-ejection head units is arrayed.

Further, as illustrated in FIG. 15, a plurality of the head units 1 may be arranged along a plurality of lines on a base member 101 so as to form a line-head array (a line-type liquid-ejection head unit). Such a configuration allows the connectors 33 to be disposed on an outer peripheral side of the head array. Accordingly, attachment and detachment of the connectors are more easily performed, thus allowing easier replacement. In this regard, FIG. 15 is a plan view illustrating the head array according to an exemplary embodiment seen from above. In FIG. 15, tanks 4 of the head units 1 are omitted for clarity.

Figure 16:
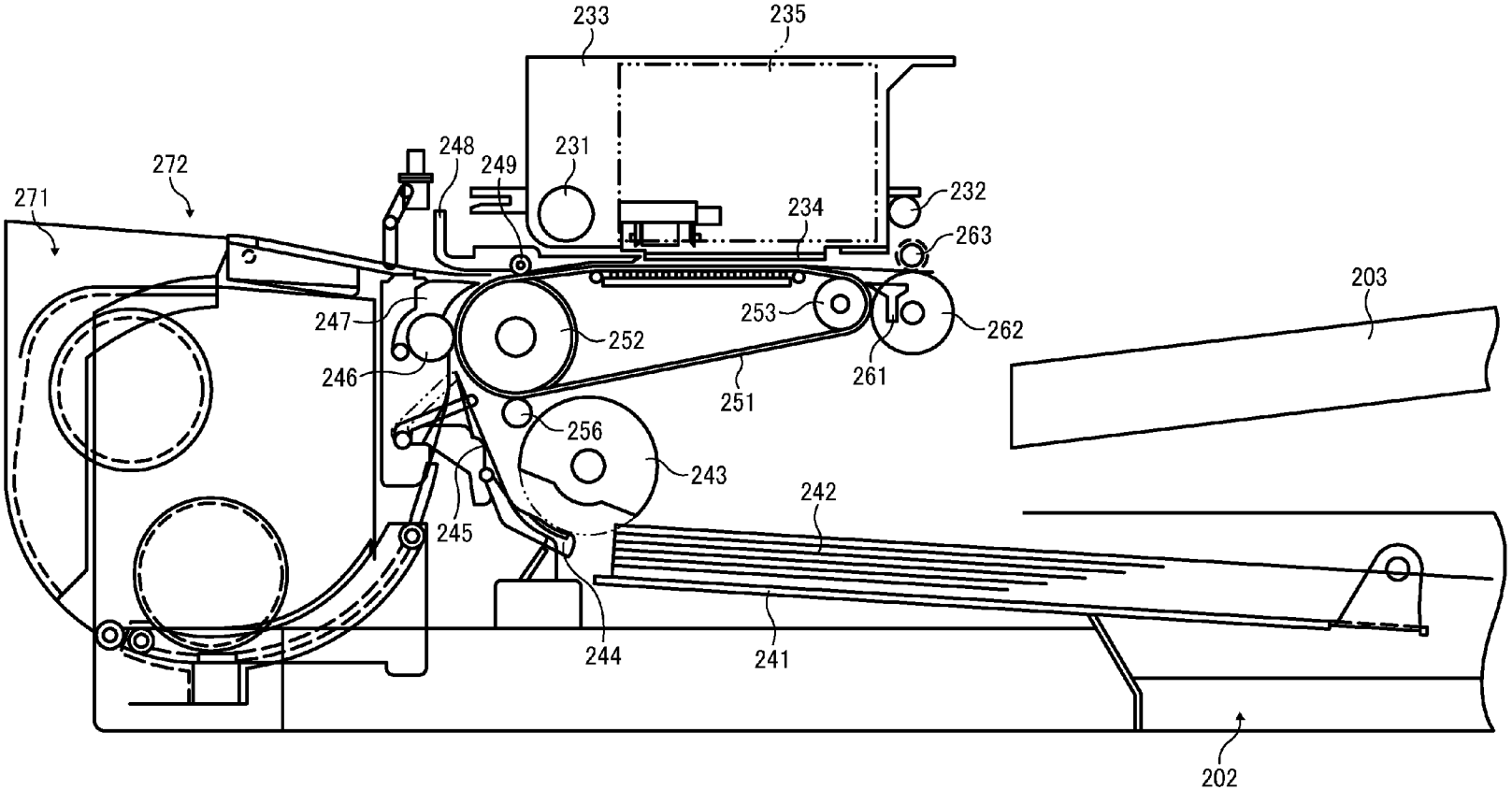
FIG. 16 is a schematic view illustrating a configuration of an image forming apparatus according to an exemplary embodiment of this disclosure.
Figure 17:
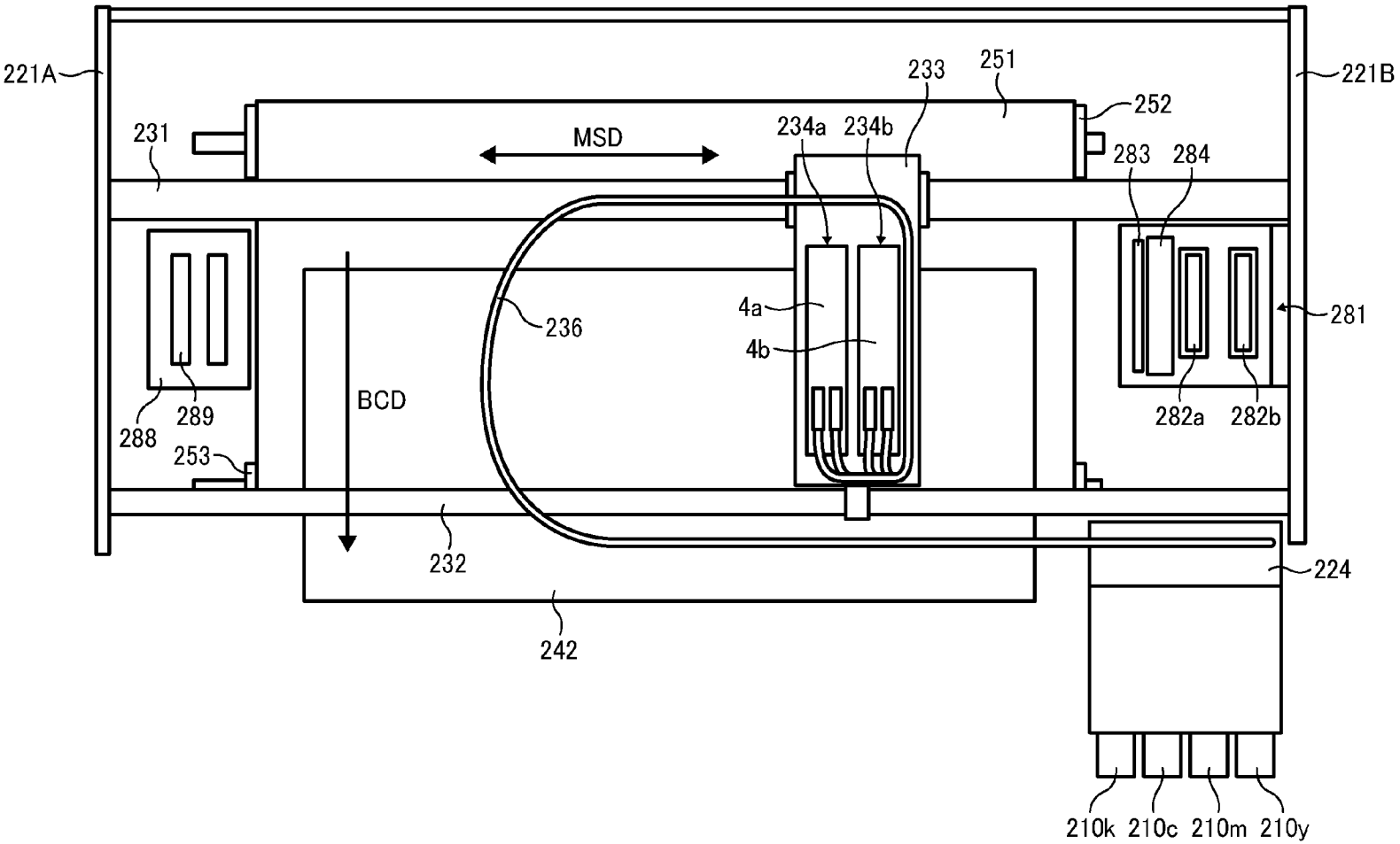
FIG. 17 is a partial plan view illustrating the image forming apparatus illustrated in FIG. 16.

Next, an image forming apparatus according to an exemplary embodiment of the disclosure is illustrated in FIGS. 16 and 17. FIG. 16 is a schematic view illustrating a configuration of a mechanical section of the image forming apparatus. FIG. 17 is a partial plan view illustrating the mechanical section illustrated in FIG. 16.

In FIGS. 16 and 17, the image forming apparatus is illustrated as a serial-type image forming apparatus. In the image forming apparatus, both a main guide rod 231 and a sub guide rod 232 extend between side plates 221A and 221B to support a carriage 233 slidable in a main scan direction "MSD" indicated by a double arrow illustrated in FIG. 17. The carriage 233 moves for scanning by a main scan motor, not illustrated, via a timing belt.

A recording-head assembly 234 includes a plurality of liquid-ejection head units according to any of the exemplary embodiments of the disclosure. The liquid-ejection head units eject ink droplets of the corresponding colors, e.g., yellow (Y), cyan (C), magenta (M), and black (K). The recording-head assembly 234 is mounted on the carriage 233 so that a plurality of nozzle rows consisting of nozzles is arranged in a sub-scan direction perpendicular to the main scan direction so as to eject ink droplets downward.

The recording-head assembly 234 includes liquid-ejection head units 234*a* and 234*b* mounted on a base member. Each of the liquid-ejection head units 234*a* and 234*b* may include, e.g., two nozzle rows. For example, the head unit 234*a* may eject black ink droplets from one nozzle row and cyan ink droplets from the other nozzle row, and the head unit 234*b* may eject magenta ink droplets from one nozzle row and yellow ink droplets from the other nozzle row. In this exemplary embodiment, the recording-head assembly 234 includes two liquid-ejection heads that eject droplets of four colors. However, it is to be noted that the head configuration is not limited to such configuration and, for example, as described above, four nozzle rows may be formed in each head to eject ink droplets of four different colors.

A supply unit 224 supplies (replenishes) respective color inks from corresponding ink cartridges 210 through corresponding supply tubes 236 to tanks 4*a* and 4*b* of the recording-head assembly 234.

The image forming apparatus further includes a sheet feed section that feeds sheets 242 stacked on a sheet stack portion (platen) 241 of a sheet feed tray 202. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and biased toward the sheet feed roller 243.

To feed the sheet 242 from the sheet feed section to a portion below the recording heads 234, the image forming apparatus 2000 includes a first guide member 245 that guides the sheet 242, a counter roller 246, a conveyance guide member 247, a press member 248 including a front-end press roller 249, and a conveyance belt 251 that conveys the sheet 242 to a position facing the recording-head assembly 234 with the sheet 242 electrostatically attracted thereon.

The conveyance belt 251 is an endless belt that is looped between a conveyance roller 252 and a tension roller 253 so as to circulate in a belt conveyance direction "BCD", that is, the sub-scan direction. A charge roller 256 is provided to charge the surface of the conveyance belt 251. The charge roller 256 is disposed to contact the surface of the conveyance belt 251 and rotate depending on the circulation of the conveyance belt 251. By rotating the conveyance roller 252 by a sub-scan motor, not illustrated, via a timing roller, the conveyance belt 251 circulates in the belt conveyance direction "BCD" illustrated in FIG. 17.

The image forming apparatus 2000 further includes a sheet output section that outputs the sheet 242 on which an image has been formed by the recording heads 234. The sheet output section includes a separation claw 261 that separates the sheet 242 from the conveyance belt 251, a first output roller 262, a second output roller 263, and the sheet output tray 203 disposed below the first output roller 262.

A duplex unit 271 is removably mounted on a rear portion of the image forming apparatus 2000. When the conveyance belt 251 rotates in reverse to return the sheet 242, the duplex unit 271 receives the sheet 242 and turns the sheet 242 upside down to feed the sheet 242 between the counter roller 246 and the conveyance belt 251. At the top face of the duplex unit 271 is formed a manual-feed tray 272.

In FIG. 17, a maintenance unit 281 is disposed at a non-print area on one end in the main-scan direction of the carriage 233. The maintenance unit 281 including a recovery device maintains and recovers nozzles of the recording head assembly 234. The maintenance unit 281 includes cap members 282*a* and 282*b* (hereinafter collectively referred to as "caps 282" unless distinguished) that cover the nozzle faces of the recording head assembly 234, a wiping blade 283 that is a blade member to wipe the nozzle faces of the recording head assembly 234, and a first droplet receiver 284 that receives ink droplets during maintenance ejection performed to discharge increased-viscosity ink.

In FIG. 17, a second droplet receiver 288 is disposed at a non-print area on the other end in the main-scan direction of the carriage 233. The second droplet receiver 288 receives ink droplets that are ejected to discharge increased-viscosity ink in recording (image forming) operation and so forth. The second droplet receiver 288 has openings 289 arranged in parallel with the rows of nozzles of the recording head assembly 234.

In the image forming apparatus 2000 having the above-described configuration, the sheet 242 is separated sheet by sheet from the sheet feed tray 202, fed in a substantially vertically upward direction, guided along the first guide member 245, and conveyed with sandwiched between the conveyance belt 251 and the counter roller 246. Further, the front tip of the sheet 242 is guided with a conveyance guide 237 and pressed with the front-end press roller 249 against the conveyance belt 251 so that the traveling direction of the sheet 242 is turned substantially 90 angle degrees.

At this time, plus outputs and minus outputs, i.e., supply positive and negative voltages are alternately applied to the charge roller 256 so that the conveyance belt 251 is charged with an alternating voltage pattern, that is, an alternating band pattern of positively-charged areas and negatively-charged areas in the sub-scanning direction, i.e., the belt circulation direction. When the sheet 42 is fed onto the conveyance belt 251 alternately charged with positive and negative charges, the sheet 242 is electrostatically attracted on the conveyance belt 251 and conveyed in the sub-scanning direction by circulation of the conveyance belt 251.

By driving the recording head assembly 234 in response to image signals while moving the carriage 233, ink droplets are ejected on the sheet 242 stopped below the recording head assembly 234 to form one band of a desired image. Then, the sheet 242 is fed by a certain amount to prepare for recording another band of the image. Receiving a signal indicating that the image has been recorded or the rear end of the sheet 242 has arrived at the recording area, the recording head assembly 234 finishes the recording operation and outputs the sheet 242 to the sheet output tray 203.

As described above, the image forming apparatus includes the liquid-ejection head units according to any of the exemplary embodiments of the disclosure, thus enhancing reliability and downsizing the head and the apparatus.

Next, an image forming apparatus according to another exemplary embodiment of this disclosure that includes the liquid ejection head according to an exemplary embodiment of this disclosure is described with reference to FIG. 18.

Figure 18:
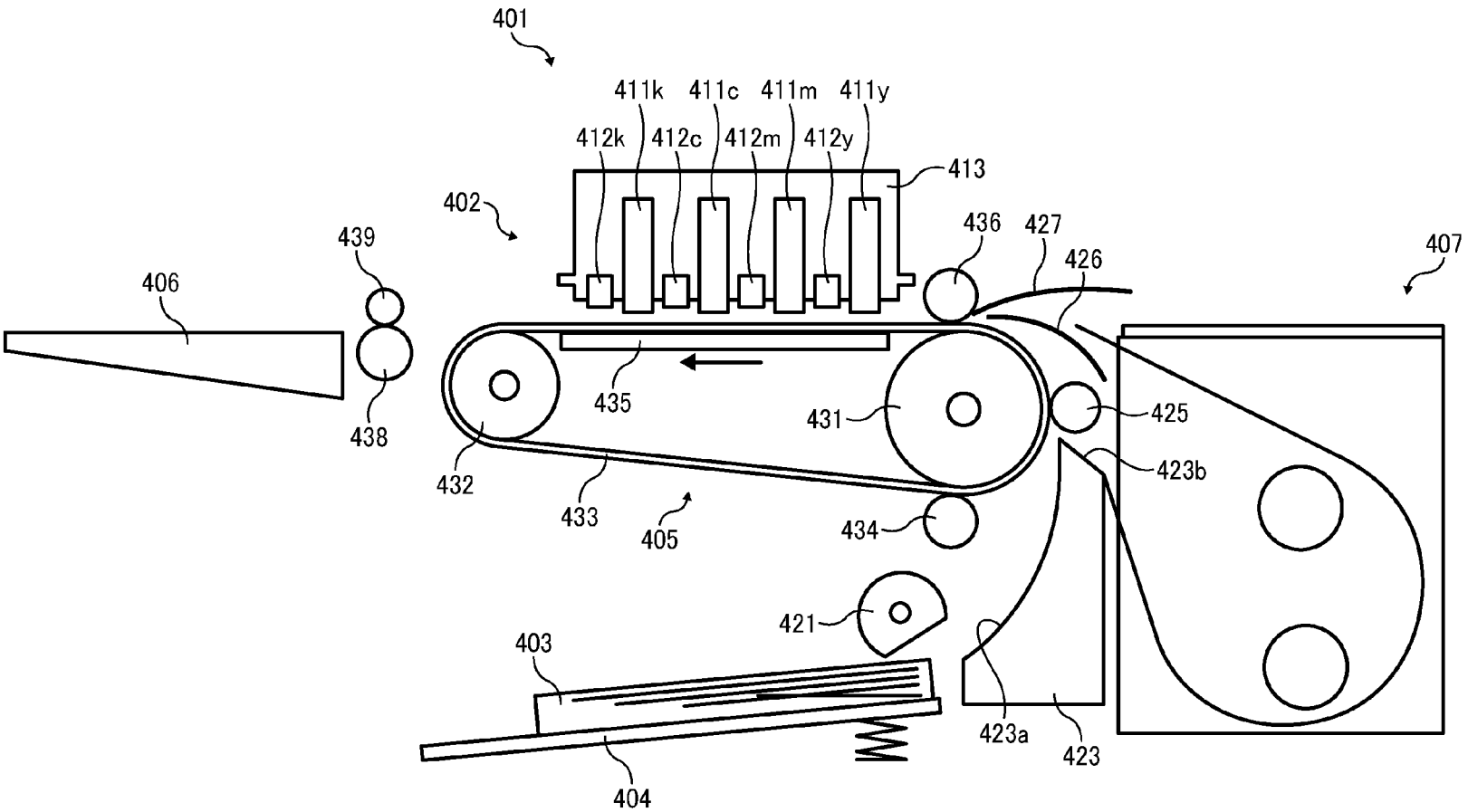
FIG. 18 is a schematic view illustrating a configuration of an image forming apparatus according to another exemplary embodiment.

FIG. 18 is a schematic view illustrating a mechanical section of the image forming apparatus.

In FIG. 18, the image forming apparatus is illustrated as a line-head-type image forming apparatus and includes, an image forming section 402, a sheet feed tray 404, a conveyance unit 405, and a sheet output tray 406. A plurality of recording sheets 403 is stacked on the sheet feed tray 404 at a lower portion of the image forming apparatus. When the recording sheet 403 is fed from the sheet feed tray 404, the image forming section 402 records an image on the recording sheet 403 conveyed by the conveyance unit 405, and then the conveyance unit 405 outputs the recording sheet 403 to the sheet output tray 406 mounted on a lateral side of the image forming apparatus.

A duplex unit 407 removably mountable to the image forming apparatus. In double-face printing, when printing on one face of the recording sheet 403 is finished, the recording sheet 403 is turned upside down by the conveyance unit 405 and sent into the duplex unit 407. Accordingly, the duplex unit 407 feeds the other face of the recording sheet 403 as a printable face to the conveyance unit 405 again. The image forming section 402 records an image on the other face of the recording sheet 403 and outputs the sheet 403 to the sheet output tray 406.

The image forming section 402 includes, for example, full-line type recording head units 411Y, 411M, 411C, and 411K (hereinafter, referred to as "recording head units 411" unless colors are distinguished) as illustrated in FIG. 15. The full-line type recording head units 411Y, 411M, 411C, and 411K are formed with a plurality of liquid-ejection head units according to any of the above-described exemplary embodiments of this disclosure that ejects ink droplets of corresponding colors: yellow (Y), magenta (M), cyan (C), and black (K). Each recording head unit 411 is mounted on a head spacer member 413 so that the nozzle face having nozzles through which ink droplets are ejected is oriented downward.

The image forming apparatus includes maintenance units 412Y, 412M, 412C, and 412K (hereinafter, referred to as "maintenance units 412" unless colors are distinguished) that are provided corresponding to the recording head units 411Y, 411M, 411C, and 411K to maintain and recover the ejection performance of the liquid ejection heads. In maintenance operations such as purging and wiping, the recording head units 411 and the corresponding maintenance units 412 are relatively shifted so that the nozzle faces of the recording head units 411 oppose capping members and/or other members of the corresponding maintenance units 412.

The recording sheets 403 stacked on the sheet feed tray 404 are separated with a sheet feed roller 421 and a separation pad, not illustrated, and fed sheet by sheet toward a conveyance guide member 423. The recording sheet 403 is sent between a registration roller 425 and a conveyance belt 433 along a guide face 423*a* of the conveyance guide member 423, and at a proper timing, sent onto the conveyance belt 433 of the conveyance unit 405 along a second guide member 426.

The conveyance guide member 423 also has a second guide face 423*b* that guides the recording sheet 403 sent from the duplex unit 407. The image forming apparatus 4000 includes a third guide member 427 that guides the recording sheet 403, which is returned from the conveyance unit 405 in duplex printing, toward the duplex unit 407.

The conveyance unit 405 includes the conveyance belt 433 that is an endless belt looped between a conveyance roller 431 and a driven roller 432, a charge roller 434 that charges the conveyance belt 433, a platen member 435 that maintains flatness of a portion of the conveyance belt 433 facing the image forming section 402, a press roller 436 that presses the recording sheet 403 sent from the conveyance belt 433 against the conveyance roller 431, and a cleaning roller formed with a porous member to remove residual recording liquid (ink) adhered on the conveyance belt 433. The conveyance unit may attract the recording sheet 403 onto the conveyance belt 433 by, for example, air suction.

At the downstream side of the conveyance unit 405 is disposed a sheet output roller 438 and a spur 439 to send the recording sheet 403, on which an image has been recorded, to the sheet output tray 406.

In the image forming apparatus 4000 of such a configuration, the conveyance belt 433 is circulated in a direction indicated by an arrow illustrated in FIG. 18 and charged by contacting the charge roller 434 to which a high-potential voltage is supplied. When the recording sheet 403 is conveyed onto the conveyance belt 433 charged, the recording sheet 403 is attracted on the conveyance belt 433. Thus, such strong attachment of the recording sheet 403 against the conveyance belt 433 prevents curling and surface irregularity of the recording sheet 403, thus forming a highly flattened face.

When the recording sheet 403 is moved by circulating the conveyance belt 433, the recording head units 411 eject droplets of recording liquid to form an image on the recording sheet 403. After image recording, the recording sheet 403 is outputted by the output roller 438 to the sheet output tray 406.

As described above, the image forming apparatus includes the liquid-ejection head unit according to an exemplary embodiment of this disclosure, thus improving the reliability and downsizing the head and the apparatus.

In the exemplary embodiment described above, the image forming apparatus is configured as the printer. However, it is to be noted that the image forming apparatus is not limited to the printer and may be, for example, a facsimile, a copier, or a multi-functional peripheral having several of the foregoing capabilities. Further, the above-described embodiments may be implemented in the image forming apparatus that employs, e.g., liquid other than ink in narrow definition, or fixing processing agent.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and appended claims.

What is claimed is:

1. A liquid-ejection head unit comprising:

a head comprising a frame member to eject droplets of liquid;

an electric-circuit board;

electronic components mounted on the electric-circuit board and connected to the head; and a storage tank that stores liquid supplied to the head, the electric-circuit board disposed between the frame member of the head and the storage tank to form a single multi-layered structure, the electronic components of the electric-circuit board accommodated in at least one of a first internal space defined by the frame member of the head and the electric-circuit board and a second internal space defined by the electric-circuit board and the storage tank.

2. The liquid-ejection head unit according to claim 1, further comprising a contact portion defining an area of contact between the frame member and the storage tank.

3. The head unit according to claim 1, further comprising a shield member disposed between the electrical-circuit board and the storage tank to shield liquid.

4. The head unit according to claim 1, further comprising:

a flexible member mounted on a lateral side of the storage tank, wherein the shield member is disposed away from the flexible member; and a spacer member that holds the shield member away from the flexible member.

5. The head unit according to claim 1, further comprising at least one seal member disposed in at least one of the first internal space and the second internal space.

6. The head unit according to claim 1, further comprising an intermediate member disposed between the frame member and the electric-circuit board to define an outer periphery of the first internal space.

7. The head unit according to claim 1, further comprising a channel portion that communicates the head and the storage tank through the electric-circuit board.

8. The head unit according to claim 1, further comprising:

at least four pressure generation members;

a plurality of flexible wiring boards comprising input terminals, the plurality of flexible wiring boards connected to the at least four pressure generation members, the flexible wiring boards led through openings in the electric-circuit board to a connection face of the electric-circuit board on which the flexible wiring boards are connected to the electric-circuit board; and a main board of the electric-circuit board on which a plurality of connectors and the electronic components are mounted, the plurality of connectors of the electric-circuit board disposed side by side in a long direction of the main board, the flexible wiring boards comprising end portions near the input terminals, the end portions bent at positions at which the and portions do not face each other and connected to the electric-circuit board.

9. An image forming apparatus comprising the liquid-ejection head unit according to claim 1.

10. A liquid-ejection head unit comprising:

a head comprising a frame member to eject droplets of liquid;

an electric-circuit board;

electronic components mounted on the electric-circuit board and connected to the head;

a storage tank that stores liquid supplied to the head; and a filter unit disposed between the storage tank and the electric-circuit board that filters liquid supplied from the storage tank, the filter unit, the frame member, the electric-circuit board, and the storage tank forming a single multi-layered structure, the electronic components of the electric-circuit board accommodated within at least one of a first internal space defined by the frame member of the head and the electric-circuit board and a second internal space defined by the electric-circuit board and the filter unit.

11. The head unit according to claim 10, further comprising:

at least four pressure generation members;

a plurality of flexible wiring boards comprising input terminals, the plurality of flexible wiring boards connected to the at least four pressure generation members, the flexible wiring boards led through openings of the electric-circuit board to a connection face of the electric-circuit board on which the flexible wiring boards are connected to the electric-circuit board; and a main board of the electric-circuit board on which a plurality of connectors and the electronic components are mounted, the plurality of connectors of the electric-circuit board disposed side by side in a long direction of the main board, the flexible wiring boards comprising end portions near the input terminals, the end portions bent at positions at which the end portions do not face each other and connected to the electric-circuit board.

12. An image forming apparatus comprising the liquid-ejection head unit according to claim 10.

* * * * *